US008361287B2

(12) United States Patent
Penna Wittig et al.

(10) Patent No.: US 8,361,287 B2
(45) Date of Patent: Jan. 29, 2013

(54) LATERAL EXHAUST ENCLOSURE-AIDED MIST CONTROL SYSTEM IN METAL ELECTROWINNING AND ELECTROREFINING CELLS

(76) Inventors: Fernando Penna Wittig, Santiago (CL); Cristian Villaseca Castro, Santiago (CL)

( * ) Notice: Subject to any disclaimer, the term of this patent is extended or adjusted under 35 U.S.C. 154(b) by 407 days.

(21) Appl. No.: 12/674,209

(22) PCT Filed: Aug. 21, 2008

(86) PCT No.: PCT/US2008/009952

§ 371 (c)(1),
(2), (4) Date: Jun. 16, 2010

(87) PCT Pub. No.: WO2009/025837

PCT Pub. Date: Feb. 26, 2009

(65) Prior Publication Data

US 2011/0108414 A1 May 12, 2011

(30) Foreign Application Priority Data

Aug. 23, 2007 (CL) ..... 2451-2007

(51) Int. Cl.
*C25C 7/00* (2006.01)
*C25C 1/12* (2006.01)

(52) U.S. Cl. ..... 204/278.5; 204/278; 204/288.1; 205/574; 205/586; 205/94

(58) Field of Classification Search ..... 205/94; 204/278.5
See application file for complete search history.

(56) References Cited

U.S. PATENT DOCUMENTS 3,948,747 A * 4/1976 Cordiano et al. ..... 204/242
4,075,069 A * 2/1978 Shinohara et al. ..... 205/560
(Continued)

FOREIGN PATENT DOCUMENTS

CL 247-1999 2/1999
CL 572-2001 3/2001

OTHER PUBLICATIONS

Liow et al, Acid mist formation in the electrowinning of copper, Proceedings of the 35th Australasian Chemical Engineering Conference 2007, Melbourne, Victoria, Australia, Sep. 2007.*

(Continued)

*Primary Examiner* — Harry D Wilkins, III
(74) *Attorney, Agent, or Firm* — Ladas & Parry LLP

(57) ABSTRACT

A multi-element cover system for controlling acid mist in metal electrowinning or electrorefining cells is made of an electrolyte resistant material and is applied above the surface of the electrolyte and below the electrical connections of the electrodes in order to provide a continuous and substantially airtight seal above the electrolyte. The cover system comprises a plurality of flexible longitudinally concave caps arranged between the cathode and the anode that help to shift the acid mist towards the sides of the cell using the same energy that disengages it from the electrolyte; lids between the electrodes and the wall of the corresponding end of the cell; and lateral enclosures located at both sides of the cell in the space between the electrodes and the lateral walls of the cell, the lateral enclosures having at least a top side, end walls at each end and an inner side projecting towards the electrolyte, thus forming a chamber inside the lateral enclosure, with the lower side of the enclosure or the electrolyte itself acting as the bottom boundary of the chamber, the chamber being connected to external acid mist suction means and its inner side provided with bores above the electrolyte level so as to in this fashion, in collaboration with the flexible caps, uniformly suck and remove the acid mist confined under the caps throughout the entire cell with a gentle suction and without the risk of crystal formation due to oversaturation of the droplets contained in the mist.

35 Claims, 6 Drawing Sheets

U.S. PATENT DOCUMENTS

| | | | | | |
|---|---|---|---|---|---|
| 4,282,082 | A | * | 8/1981 | Cook et al. | 204/237 |
| 4,288,305 | A | * | 9/1981 | Garritsen et al. | 205/587 |
| 4,584,082 | A | * | 4/1986 | Smith | 204/278 |
| 4,668,353 | A | * | 5/1987 | Smith et al. | 205/628 |
| 5,470,445 | A | * | 11/1995 | Murray et al. | 205/560 |
| 5,609,738 | A | | 3/1997 | Murray et al. | |
| 5,744,018 | A | * | 4/1998 | Santoyo et al. | 205/94 |
| 5,837,111 | A | * | 11/1998 | Ebert | 204/267 |
| 5,855,749 | A | | 1/1999 | Kohut et al. | |
| 5,865,963 | A | * | 2/1999 | Ebert | 204/230.3 |
| 6,054,027 | A | * | 4/2000 | Ebert | 204/267 |
| 6,120,658 | A | | 9/2000 | Dunn et al. | |
| 6,872,288 | B2 | | 3/2005 | Huens et al. | |

OTHER PUBLICATIONS

International Search Report: PCT/US08/09952.

* cited by examiner

A-A

LATERAL EXHAUST ENCLOSURE-AIDED MIST CONTROL SYSTEM IN METAL ELECTROWINNING AND ELECTROREFINING CELLS

FIELD OF THE INVENTION

The invention generally refers to a system for collecting the acid mist produced in the electrolytic processes employed in metal recovery or refining from acid solutions, processes that are known as electrowinning or electrorefining, respectively.

Metal electrowinning, also known as electrorecovery or electrodeposition, is an electrochemical process that consists of the passage of an electric current between electrodes, from an anode to a cathode, both submerged in an aqueous means or electrolytic bath that contains dissolved the metal to be recovered. The bath generally consists of an acid solution where the metal is deposited from the solution onto the cathode. The anodes are preferably flat plates of an insoluble metal that are not consumed in the process, while the cathodes consist of thin, flat and rigid plates of the pure metal or a metal alloy that are resistant to corrosive acids. The anode plates remain in place and are removed only for cleaning, while the cathodes must be periodically withdrawn in order to remove the deposited metal. The electrolyte is continuously flowing through the cells and returning to a primary tank where it is mixed with new material to maintain the rate of electrodeposition on the cathodes; to this effect each cell has inlets for the fresh electrolyte and a drain or outflow box for the spent electrolyte.

Electrorefining is an electrochemical process that consists of the passage of an electric current from a metal anode to a cathode, both submerged in an acid solution or electrolytic bath, the anode usually being the result of the melting process and has a degree of purity which is lower than that of the metal obtained in electrorefining. In this process, the metallic anode corrodes, dissolves in the electrolyte and the metal is deposited on the cathode, thus obtaining refined metal with a higher purity than that of the anode.

These processes take place in electrolytic cells where anodes and cathodes are alternately arranged side by side in corrosion resistant containers generally made of composite materials or polymer concrete, that contain the acid solution or electrolyte. The cells are arranged under a common roof in a large building known in industry as tank house or electrowinning plant.

In each cell there are electric connector bars that support the electrodes, and these are combined to form electric connections with the electrodes in order to conduct electricity through these and produce metal electrodeposition on the cathode. Separators prevent the electrodes from colliding with one another and occurrence of short-circuit between anode and cathode; at the same time they provide a minimum spacing, enough to allow metal deposition on the cathode.

The temperature of the electrolyte in the cells generally verges around 60° C. and sudden cooling of the same promptly produces salts in the form of crystals (for instance, copper sulfide in the case of copper electrowinning) that, for example, deposit on the cathodes that are being harvested; these have an impact in the quality of the produced metal and consequently in its price. Harvest is the process by which cathodes are removed from the cell in order to detach from them the metal that has adhered to the cathode plates, which after being "cleaned", are then placed back in the cell.

As a result of the electrochemical reaction that has occurred, oxygen bubbles generate on the anode when the water of the acid solution is decomposed; these bubbles saturate the electrolyte and rise to its surface where they burst, producing atomization of the wetted with the electrolyte. In this fashion an acid aerosol or acid mist is produced that escapes to the surrounding atmosphere. This is undesirable, as it constitutes a source of environmental contamination, affecting quality of the air inside the electrowinning plant, corroding the surrounding facilities and equipment and producing risks to the health of the personnel who work in the plant.

Removal of this acid mist from the surrounding atmosphere is very difficult, and requires processes that involve great energy consumption and/or complex additional systems (ventilation equipment, scrubbers, precipitators and the like) and that, nonetheless, do not entirely eliminate the above mentioned negative effects.

Moreover, it must be noted that the rate of metal deposition on the cathodes increases with the increase of electric current but so does acid mist generation. Therefore, having adequate acid mist removal and extraction means allows increasing the intensity of the current in order to have a greater copper production without having to carry out plant enlargements or to hire additional personnel for these operations.

We shall generally refer hereinafter to an electrowinning process, though it must be noted that the invention is applicable both to electrorefining and to electrowinning processes.

BACKGROUND OF THE ART

Several attempts have been made in the prior art to remove and prevent escape to the atmosphere of the acid mist that rises above the upper part of electrolytic cells. The solutions devised may be classified into four groups:

a) systems that dilute the contaminated air;
b) systems that bring down the contaminants in the acid mist;
c) chemical or physical agents that try to prevent bubble from forming or that collect these bubbles to deposit them back into the electrolytic bath; and
d) systems that capture the mist at its source of emission and evacuate it towards a central decontamination system, with or without use of forced suction.

In all these mechanisms for controlling acid mist results have been insufficient and/or have given rise to other problems. Those systems that dilute contaminated air typically comprise cross ventilation within the electrowinning plant. Bores are provided in the wall opposite to the inflow of fresh air, or even complete removal of said wall is provided, in order to extract acid mist out of the plant. However, heavy global thermal losses occur in the electrolytic process and the noxious effect on the workers, the facilities and the environment is not prevented.

Systems that reduce contaminants in the acid mist typically use sprinklers that send forth fine water drizzle that precipitate contaminants from the acid mist onto the cells and onto the plant floor. This is, however, a mere palliative that transfers contamination from aerial contamination to a diluted acid over the plant building and equipment.

The agents that try to prevent bubble formation include, among others, surfactants that decrease the surface tension of the electrolyte (and therefore, the size of bubbles generated in the anode), baffle plates that coalesce the bubbles, or else, balls, pellets or other inert floating particles that are incorporated into the acid bath and act as barriers to acid mist formation. These agents are used only as a complement of the other systems because they provide only a partial solution to the problem.

Regarding acid mist capturing systems, they typically consist of rigid or flexible covers of an electrolyte resistant material which are applied above the cells and are connected to a network of suction ducts that evacuate the mist towards a gas scrubber, plate filter, dehumidifiers and other devices in order to recover and/or carry out an environmentally friendly disposal of the acid and the contaminating substances contained in the acid mist. The idea is to generate a gentle, low-pressure suction that allows evacuation of the mist toward these ducts. The suction rate must be restrained to maintain moisture and temperature under the cover in the entire cell so as to avoid generation of crystals (salts) by over saturation of the aerosol droplets that are otherwise produced at a high rate and with cooling of the mist.

One of the best known and more widely used acid mist capture systems is one that consist of "high-energy hoods" that are placed over the anodes and cathodes and above the electrolytic bath, and comprise perforations in their bottom through which the mist is suctioned towards a centralized contamination handling system. The hoods, exemplified in Chilean patent application CL 247-1999 (Mella), have a rinsing system incorporated to keep the suction perforations free from formation of crystals that may obstruct said perforations. Still, the electrode supporting connector bars become corroded due to the thermal gradients produced when fresh air filters into the cells, in addition to other drawbacks. Moreover, hood operation must be accompanied by expensive automatic equipment to ensure accuracy and avoid damage during harvest of the cathodes, wherein said hoods are removed and subsequently replaced. During the harvest operation the electrolytic bath is necessarily exposed to the ambient and a gust of acid mist is produced that escapes to the surrounding atmosphere and requires the use of secondary ventilation systems.

Another of these acid mist capture systems consist of roofs or covers that are installed above the electrolytic bath surface and optionally above the electrodes themselves, above or below the electric connections, forming a substantially airtight seal over the bath. The mist is confined inside the volume formed between the electrolyte surface, the cell walls and the cover, and is sucked through suction ducts, either naturally or in forced fashion.

Chilean patent application No. 527-2001 (Vidaurre) discloses an improved container design for an electrolytic cell provided of several means for decontaminating acid mist. These means mainly comprise some flat covers that entirely enclose the upper plane surface of each container from the outer surroundings. They also comprise aerosol suction ducts mounted above the level of the electrolyte, which cross through at least a heightened front wall, and also along the side walls of the container, the latter formed either on the side walls themselves or mounted on preformed plastic moldings arranged on the side walls. These suction ducts in the cell are connected to a network of outer ducts for acid mist collection and to a central suction system. In addition, water sprinklers are provided to bring down the contaminated gases inside the container.

The generic cover of this Chilean invention comprises three sections of rigid and flexible plates, that is: a central longitudinal flexible (removable) cover and two preferably rigid and transparent lateral covers that allow conducting visual inspection of the electrodes. These covers are complemented with flexible seals between the central and lateral covers, which provide gaps to allow the inflow of moderate volumes of fresh air from the plant into the container. The cover is set up over a reticular structure that rests on the plane of the electrodes and the heightened front walls. To carry out acid mist extraction, the ducts in the at least one heightened wall and on the side walls of the container are connected to lateral longitudinal extraction ducts formed between longitudinally paired containers as a result of horizontal ledges that are molded on the outer faces of the container side walls. With the central suction system, pressure in the ducts is maintained somewhat below the atmospheric pressure in the plant, thus allowing the inflow of fresh air from the plant into the container at a low rate and in moderate volumes through the gaps in the flexible seals in order to ensure confinement of the mist under the cover.

During harvest and when the electric contacts are being periodically checked and cleaned, the longitudinal covers are removed. This adds an extra operation to the harvest, and makes the escape of acid mist to the surroundings inevitable, even if the central suction system is kept in operation.

U.S. Pat. No. 5,609,738 (Murray et al.) discloses a multi-element cover system applied below the electrode connections and above the surface of the electrolytic bath which does not require to be removed during the harvest and includes: a) flat caps that are placed against the anodes and span towards the contiguous cathodes; b) flexible plastic bands on the tank sides; and c) covers on the cell ends. The acid mist is evacuated naturally through the discharge weir for spent electrolyte, or via the overflow box. The free section above the weir duct generates a pressure differential and a natural suction that allows the mist to flow out, and it is also possible to use forced draft in the drainage system.

When this solution was applied to a real operation in a copper electrowinning facility in Chile, it could be established that due to the fact that the wetted weir mouth was placed at one end of the electrode row, the suction rate determined to avoid salt deposition in the weir mouth was not sufficient to conduct a uniform extraction of the mist contained throughout the cell, and the mist was dammed up between the anodes and the cathodes that were farther from the suction point. One of the problems caused by this situation was the attack (corrosion) on the metallic surface of cathode mother plates (pitting) by the acid mist, making detachment of the copper deposited on the cathodes very difficult. After a few months of use the poor results obtained forced to discontinue this system.

The present invention solves this and other problems of the prior art related to mist capture and removal in the way that shall be described hereinafter, with the benefit of keeping the acid mist permanently under control in a simple and effective manner throughout the entire cell, even when cathode harvest takes place, thereby accomplishing a uniform capture and removal of the same throughout the cell and requiring for this a very low energy, since good use is made of the energy of the aerosol itself that is being formed over the electrolytic bath. Moreover, with the system of the invention, the cathode harvest process is not altered with additional operations and is designed to be perfectly well adapted to cells existing at present in electrowinning plants.

SUMMARY OF THE INVENTION

The present invention comprises a multi-element cover system for capturing and removing the acid mist produced in metal electrowinning and electrorefining processes, which is made of an electrolyte resisting material and completely covers each cell above the electrolyte surface and below the electrical connections of the electrodes, so as to provide a continuous and substantially airtight seal over the electrolyte, avoiding escape to the atmosphere of the acid mist confined under the cover at any point of the cell.

In the first place, the cover system comprises a plurality of flexible caps arranged between anode and cathode, the caps being of a longitudinally concave shape to help in shifting the acid mist towards the sides of the cell using the same energy with that disengages it from the electrolyte. It further comprises lids that span the electrolyte from the electrodes located at each end of the row of electrodes of each cell to the wall of the corresponding end of the cell. Finally, the cover system includes lateral enclosures located at both sides of the cell in the space between the electrodes and the cell lateral walls, each lateral enclosure having at least a top, end walls at each end and an inner side projecting towards the electrolyte in order to form a chamber within the lateral enclosure, either together with a bottom side disposed above the electrolyte level or with the electrolyte itself forming the lower boundary of the chamber, wherein said chamber is connected to outer means for suction of the acid mist and said inner side that projects towards the electrolyte is provided with bores above the electrolyte level in order to suction, in collaboration with the flexible caps, the acid mist confined under the caps towards the chamber and to extract it uniformly along the entire cell, with a gentle suction and without the risk of crystal formation due to over saturation of the droplets contained in the mist.

Preferably the flexible caps are of either longitudinally "U-shaped" or of another similar form inclined downwards from the sides of the caps towards their center, this allowing the mist to be naturally shifted towards the mist suction bores located in the side of the lateral enclosures that projects towards the electrolyte, in front of the electrodes. For this purpose, these bores are disposed in the upper area of the inner sides of said lateral enclosure.

Notwithstanding the above, it is possible to vary the shape of the caps in search of an improved natural extraction of the mist through the bores in the lateral closures. For example, a central vertical element may be included that descends from the cap down to the surface of the electrolyte, perpendicular to the electrodes, in order to split in two the volume of the mist being evacuated from the electrolyte and thus guide the flow of mist generated in one side of the cell towards one lateral enclosure, and the flow of mist generated in the other side of the cell towards the other lateral enclosure.

Moreover, the flexible caps have a shape and a construction adapted to be affixed to both sides of each anode and extending towards the adjoining cathodes. They are built with a rigid part that confers the cap its shape and serves as substrate for their attachment to the anode, and a part made of an elastomeric material that confers them flexibility and sealing capability. In particular, the part made of elastomeric material allows to maintain a seal in the intersections of the caps with the cathodes and the lateral enclosures, and allows the caps to yield so that the cathodes covered with electrodeposited metal may be withdrawn and, subsequently, the now "clean" cathodes reinserted without losing the continuous and substantially airtight seal above the electrolyte.

The rigid part of the flexible caps may include a web made of glass fiber or other plastic material that is embedded in the elastomeric material or, alternatively, it may be a rigid component with a continuous groove where the part made of elastomeric material is inserted. Fastening of the caps is done preferably by means of corrosion resistant bolts and nuts, through bores in the rigid part of the caps that match with corresponding bores of an equivalent diameter on the wall of the anode.

The part of the flexible caps made of elastomeric material is arranged substantially along the entire length of the caps and forms eaves above the electrolytic bath of a width sufficient to form a substantially adequate seal with the cathodes. The configuration of the eaves may vary in search of a better seal, preferably being of one piece, with a shape that slants towards the anode and with the edge of its transverse end being thinner than the rest. It is preferred that the lateral ends of the cap where these intersect the lateral closures, be exclusively of an elastomeric material so that a better seal is achieved and for ease of installation. On the other hand, the eaves are preferably hollow inside to provide thermal insulation means between the electrolyte and the environment.

In turn, the lids may be flat but they are preferably similar in shape to the flexible caps. On the other hand, the junction of the caps with the end inner walls of the cell may be an abutment joint or, in an alternative cap design, in order to avoid structural and sealing problems, they extend vertically and parallel along the respective inner surfaces of the end walls of the cell up to the top edge of the cell where they rest. In this case the lids are mostly rigid (they have elastomeric material only on their sides), and may comprise means for airtight attachment against the cell walls, such as bands or coatings of an elastomeric material.

The lateral enclosures have a shape that adapts to the space between the electrodes and the lateral inner walls of the cell, leaving a certain room to allow size differences between cathodes. They are preferably of a length that matches the inner length of the cell sides and are located perpendicularly to the plane of anodes and cathodes. Furthermore, they may also include means for airtight attachment against the cell walls, such as bands or coatings of an elastomeric material. Likewise, the outer face on top of the lateral enclosure is preferably provided with a protrusion or an upper member attached, of a shape adapted to provide the flexible caps with a better support and contribute to the seal over the electrolyte at the intersection of the flexible caps with the lateral enclosures.

In a preferred embodiment of the invention, the lateral enclosures have A rectangular cross section with a vertical side placed against the side of the cell. In another preferred embodiment of the invention, the lateral enclosures may have a polygonal cross section. Regardless of their form, the lateral enclosures may or may not have their lower part submerged in the electrolyte, and if the lateral enclosures are submerged in the electrolyte, the lower side may have bores or may be completely open underneath. Likewise, in a preferred embodiment of the invention, when the inner chamber of the lateral enclosures is bounded by the electrolyte, the lateral enclosures have a cross section that tapers both in their lower part and above the electrolyte to provide a space for circulation of the impurities that float on the electrolyte.

With regard to their assembly, the lateral enclosures are supported on the upper surface of the corresponding lateral wall of the cell by a single or several horizontal projections that extend either on or in the same prolongation of the top side of the lateral enclosures, towards the outer edges of the cell. Preferably, said projection or projections are integral and act as a bridge between two lateral enclosures that are mounted together as a saddle over the walls of two adjacent cells that face each other.

On the top surface of at least one end of each lateral enclosure, a gas outlet pipe is arranged connecting the lateral enclosures with a network of ducts for evacuation of the acid mist towards the centralized suction and decontamination system. Typically, the centralized decontamination system includes two or more scrubbers and acid precipitators, connected in turn to one or more extractors or chimneys through which the acid-free oxygen is evacuated to the environment.

As it has already been mentioned, top surfaces of the lateral enclosures form in conjunction with the flexible caps, or at the ends of the cell, jointly with the lids, a substantially airtight closure above the electrolyte. This airtight closure, together with the depression produced within the cell by the constant suction of a centralized suction unit, prevents the escape of the mist to the environment, and collaborates with energy savings to maintain the temperature inside the cell. In any case, a moderate and controlled filtration of air from the atmosphere to the inside of the cell may help to ensure isolation of the acid mist under the cover. In fact, in a preferred embodiment of the invention, there are means provided in the flexible caps to allow a controlled inflow of air at a low rate and in moderate volumes. Said means comprise gaps or openings in the caps and preferentially a single central opening in the lowest part of the caps, which also operates as a drain for the water that adds up during cleaning of the cathodes during the harvest process.

Optionally, the cover may also comprise means for cleaning or dissolving the acid mist in areas of potential formation of crystals by the effect of the temperature gradients formed with mist suction and the flow of fresh air into the cell. Typically, one of said areas are the mist suction bores on the lateral enclosures, and it is desirable to keep the walls of the same wet to increase their capacity for dissolving the salts that may be formed on them. To this end, an alternative consist of injecting water from a water chamber or duct formed in a protrusion, or upper member attached to the outer face of the top side of the lateral enclosures, preferably in the same protrusion or member of the lateral enclosures that helps with the support and airtight seal with the flexible caps. Water is injected by means of hoses or small sprinklers directed to each of the acid mist suction bores. To rinse said bores, provision is also made of a water tank, water pipes for feeding water to the water chambers or ducts in the lateral enclosures, and valves that permit or block the passage water, as required. As an alternative to water it is possible to use electrolyte derived from the same electrolyte recirculation circuit.

Another alternative rinsing means for the acid mist consists of a small diameter hose that begins inside the suction bore and ends submerged in the electrolyte, in order to suck electrolyte due to the effect of a pressure drop generated when the mist passes through the bore, thus permitting self cleaning of the bore with the electrolyte itself.

As a form of reducing crystal formation, the bores may also be provided with improved flow means to drag the acid mist over the edge of the bores, such as an element in the shape of a nozzle that is fitted in the bore.

Finally, means may be disposed in the cover of the invention to reincorporate the contaminants back into the electrolyte, thus reducing the amount of contaminants that must be conveyed to the network of extraction ducts connected to each lateral enclosure. For example, inside the lateral enclosures it is possible to arrange one or more baffle plates or similar elements that originate in the suction bores and extend up to the electrolyte's level, with multiple holes of a very small size or other means that force the acid particles contained in the mist to collide against the edges of the small holes and are incorporated again into the electrolyte.

In any case, as the inner chamber of the lateral enclosures is in one embodiment of the invention bounded at the bottom by the electrolyte and the level of the latter within the lateral enclosures equals the level existing outside the enclosure, a perfect interaction of the electrolyte flow is allowed between the interior of the lateral enclosures and the cell, enabling reduction of crystal formation as the temperature within the lateral enclosures is kept stable, thus avoiding cooling that causes said crystals to form.

The application of the present invention to electrorefining processes might include adaptation of the design of the caps, for example, to allow modification of the flexible cap attachment from anodes to cathodes.

BRIEF DESCRIPTION OF THE DRAWINGS

A brief description of the drawings is provided below illustrating a preferred model of the invention applied to a metal electrowinning process.

The following elements may be distinguished in the figures.

Figure 1:
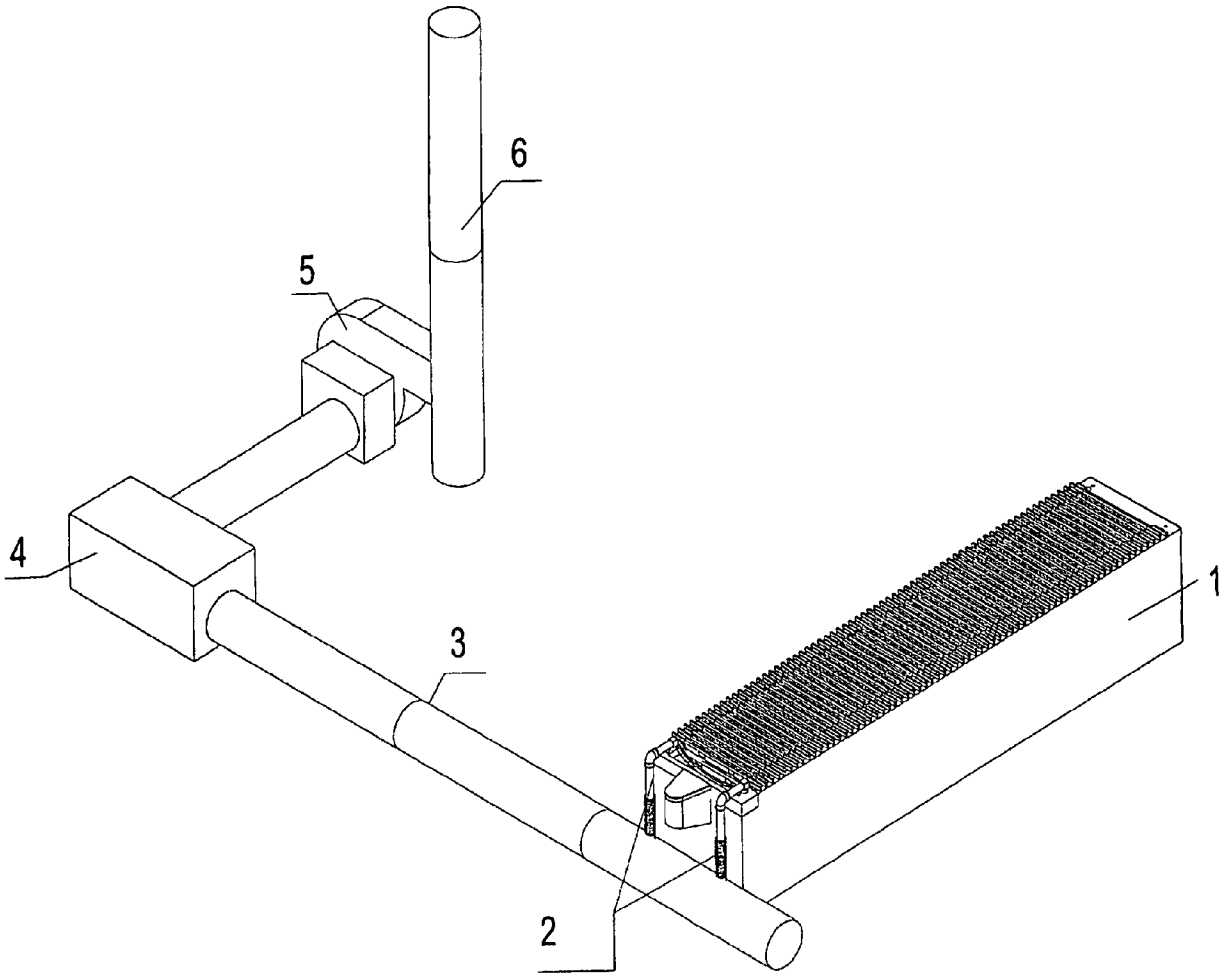
FIG. 1 represents the general arrangement of one of the electrolytic cells that form part of a battery or bank of cells in the electrowinning plant, connected to a centralized suction and decontamination system, where pipes for the outlet of gases from the lateral enclosures according to the invention may be observed coupled to a mist evacuation duct, part of a network of ducts that lead to a gas scrubber, an extractor and a chimney for the evacuation of clean air.
Figure 2:
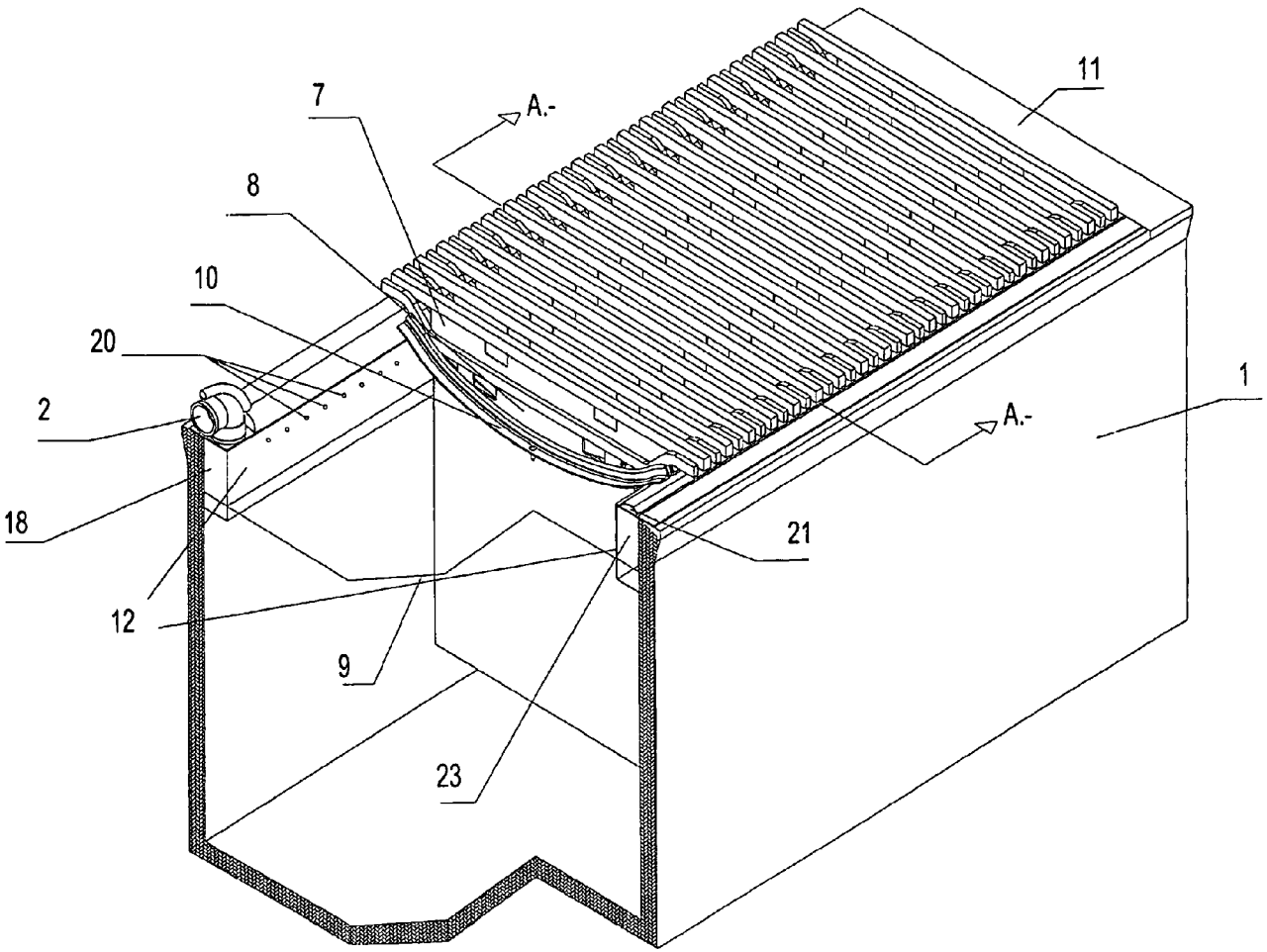
FIG. 2 represents a cross-sectional view in perspective of an electrolytic cell, where some of the electrodes at the beginning of the cell and corresponding end lid have been omitted, allowing to distinguish a U-shaped flexible cap and the lateral enclosures, further showing the electrolyte level.
Figure 3:
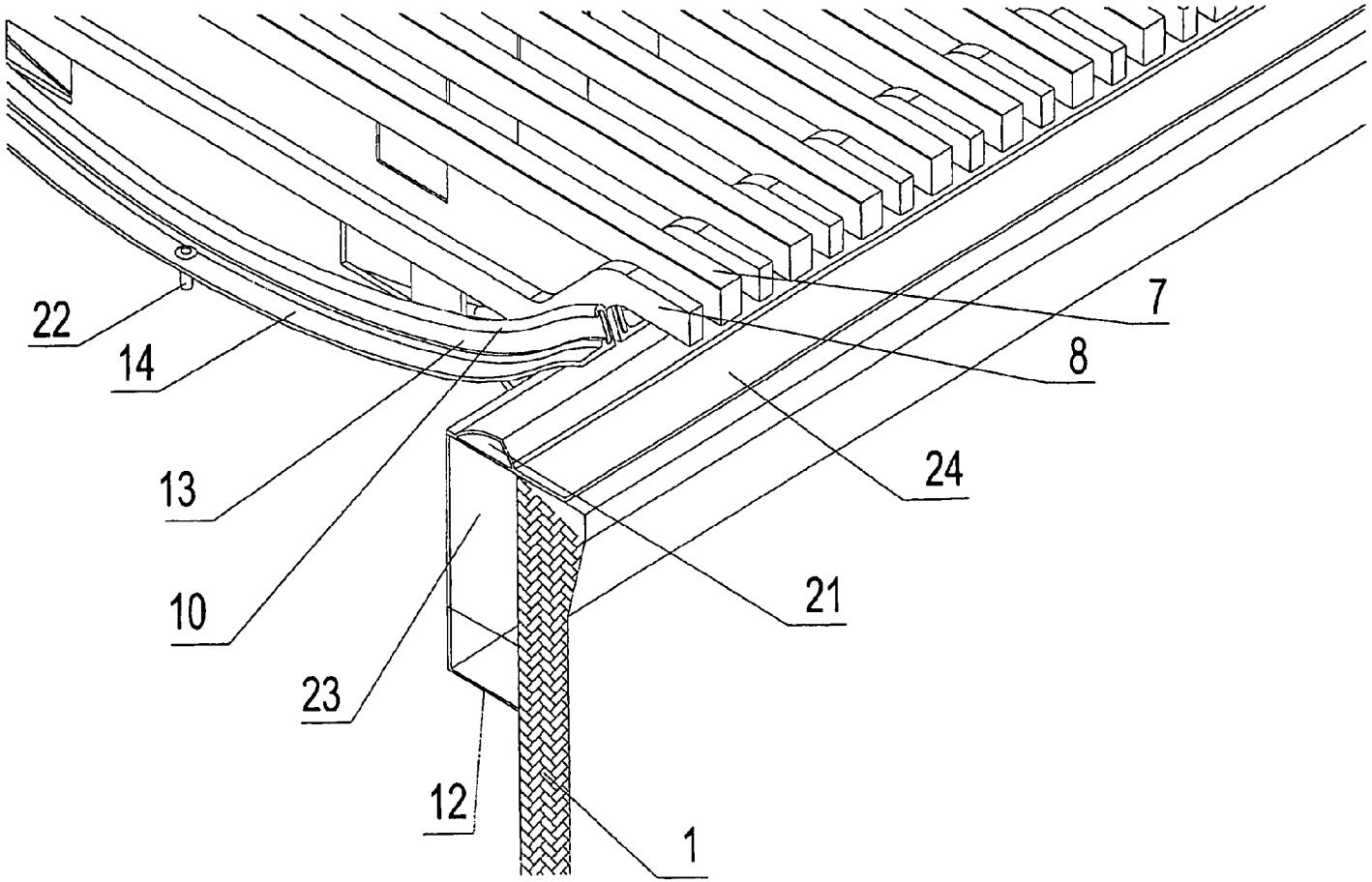
FIG. 3 represents an enlarged detail of FIG. 2 showing the area where a cap intersects a lateral enclosure on one side of the cell, and it is also possible to note a horizontal projection that supports the lateral enclosure on the cell wall and a hollow protrusion on the outer face of the top side of the lateral enclosure.
Figure 4:
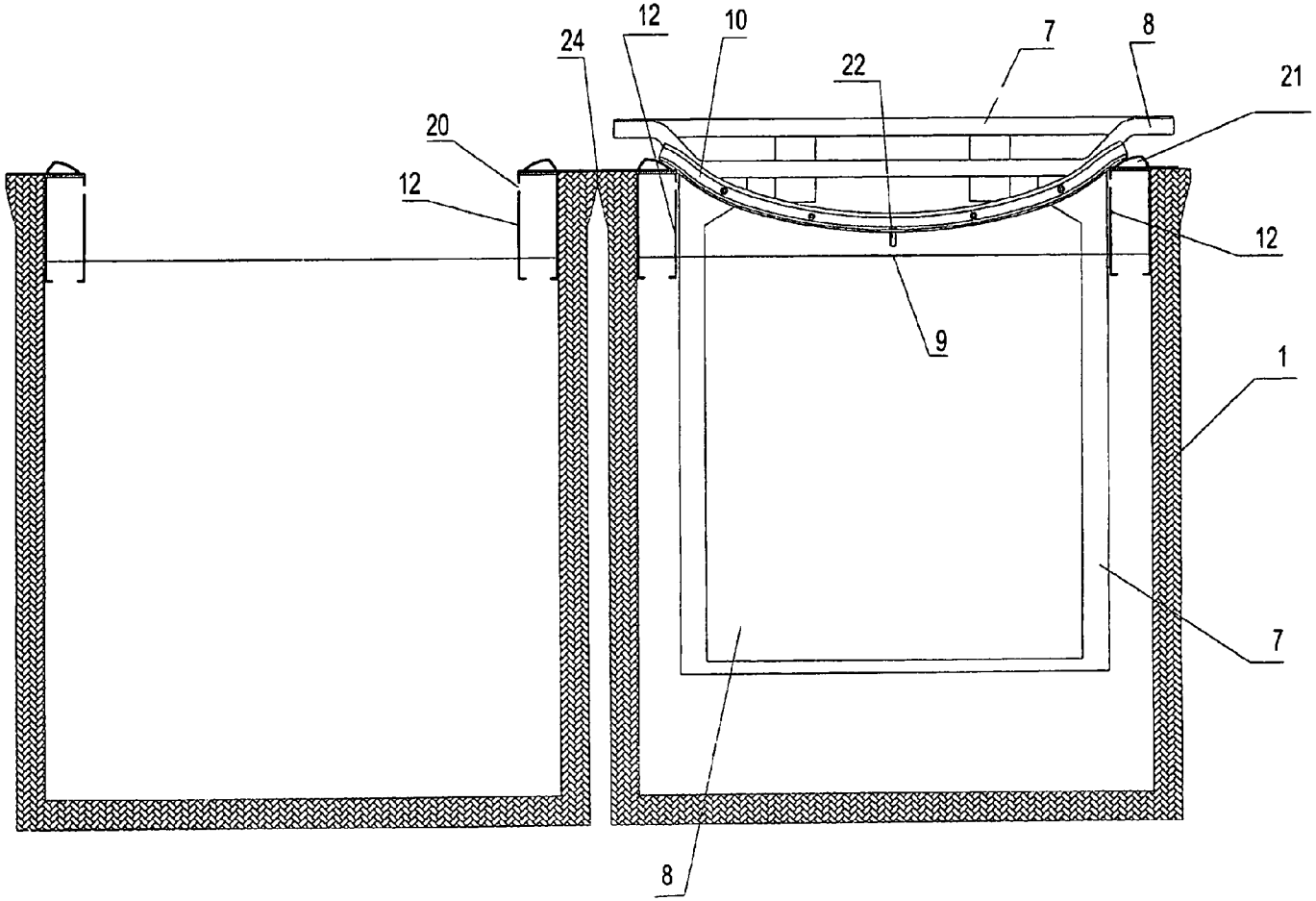
FIG. 4 shows a cross-sectional view along A-A of the cell in FIG. 2 together with another adjacent cell, shown here incomplete for the sole purpose of illustrating an embodiment of the invention where two lateral enclosures are installed in conjunction, as a saddle, on the lateral walls of two adjacent cells that face each other, with cut A-A being effected right over the front edge of the eave of a flexible cap located approximately midway along the length of the cell.
Figure 5:
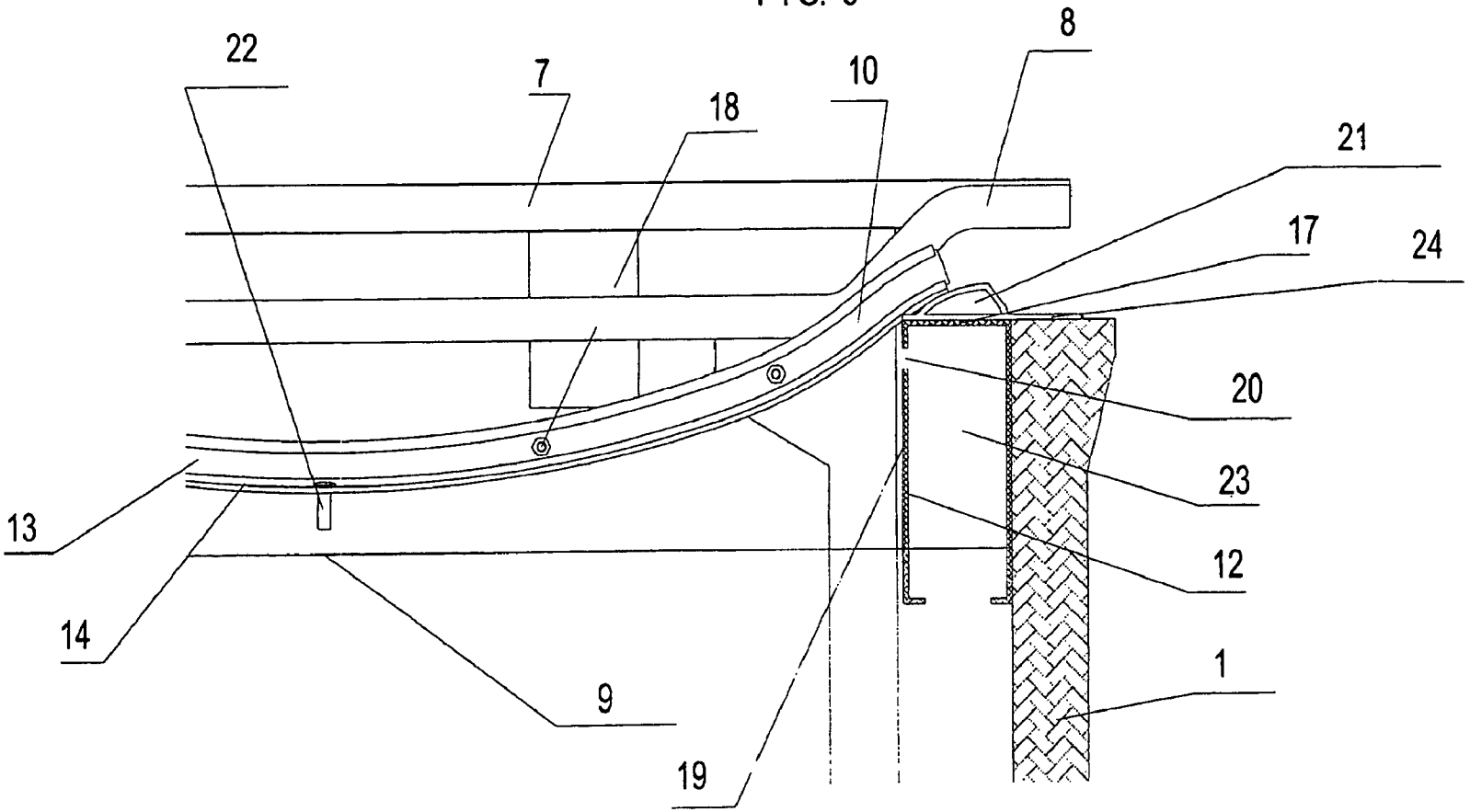
FIG. 5 represents an enlarged detail of FIG. 4 showing the area from the lowest part of the flexible cap to where it is supported on one side thereof on a lateral enclosure.

1. Electrolytic cell
2. Acid mist outlet pipe
3. Acid mist evacuation duct
4. Scrubber
5. Extractor
6. Clean air evacuation chimney
7. Cathode
8. Anode
9. Electrolyte (surface level)
10. Flexible cap
11. Lid of the end of the cell
12. Lateral enclosure
13. Rigid part of the flexible cap
14. Eave of the flexible cap
15. Inner hollow of the eave
16. Attachment means of the flexible cap to the anodes
17. Top side of the lateral enclosure
18. End wall of the lateral enclosure

19. Inner side of the lateral enclosure that projects to the electrolyte
20. Acid mist suction bores
21. Lateral enclosure upper protrusion
22. Drain-bore
23. Inner chamber of the lateral enclosure
24. Horizontal projection of the lateral enclosure

OPERATION

In a metal electrowinning process in banks of electrolytic cells (1) installed in an electrowinning plant, an electric current is passed between pairs of anodes (8) and cathodes (7) submerged in an electrolytic bath (9). The acid mist generated by the process is confined in the interstitial volume comprised between the flexible caps (10), the lateral enclosures (12) and surface of the electrolyte (9), or else, in the case of the ends of the cell, the end lids (11), the end walls of cell (1) and surface of the electrolyte (9). When the acid mist rises vertically from the electrolyte surface (9), it meets the flexible caps (10), or the lids (11), and is guided to bores (20) located in the upper part that projects towards the electrolyte (9) of the inner side (19) of the lateral enclosure (12). At bores (20), the mist is suctioned towards chamber (23) formed inside the lateral enclosures (12) by the effect of the low pressure field generated by the suction system located outside of the cell (1).

The function of the caps (10) is to prevent the mist from escaping to the atmosphere and to guide the mist flow towards suction bores (20) through which the mist is sucked into the inner chamber (23) formed in the lateral enclosures (12). By a basic principle of physics, gases shall move to the field where pressure is lower, that is to say, just in front of suction bores (20). On passing through suction bores (20) this gas is accelerated and once inside the lateral enclosures (12) it is conveyed out of the cell, through gas outlet pipes (2) that are coupled to a network of mist evacuation ducts (3). The evacuation ducts (3) end in a centralized suction and decontamination system that typically comprises a scrubber (4) where the acid contained in the mist is recovered, a suction pump or extractor (5) that generates the depression that maintains a constant mist removal flow from the cell to the scrubber, and a chimney (6) through which the acid-free oxygen is expelled to the atmosphere.

The Figures illustrate as an example an acid mist capture and removal system according to the invention where flexible caps (10) are longitudinally U-shaped and the lateral enclosures (12) have a rectangular cross section and are submerged in the electrolyte (9) with their lower side or base open. Said shape of the caps (10) allow to guide the mist towards bores (20) of the lateral enclosures (12) making use of the same energy with which it sets free from the electrolyte. In the example, the top side (17), the end walls (18) and the side walls of lateral enclosures (12) are all flat surfaces that, together with the surface of the electrolyte, form the inner chamber (23) towards where the mist is extracted. According to the preceding explanation making reference to the characteristics of the invention, it is possible to use other shapes of caps (10) and enclosures (12) for the same purpose.

It is possible to provide a constant filtering of fresh air from the atmosphere of the electrowinning plant into the above mentioned interstitial volume through means provided in caps (10) for controlled fresh air inflow, such as an opening (22) in the central and lowest part of the flexible caps (10), which also serves as a drain of water accumulated during cathode (7) cleaning in the harvest process, toward the electrolyte (9). With centralized suction, pressure in lateral enclosures (12) is maintained slightly below the pressure in the atmosphere of the plant, which allows low rate and moderate volume fresh air inflow from the plant into cell (1) through said drain bores (22) with the dual benefit of confining the acid mist and allowing its extraction through lateral enclosures (12).

Figure 6:
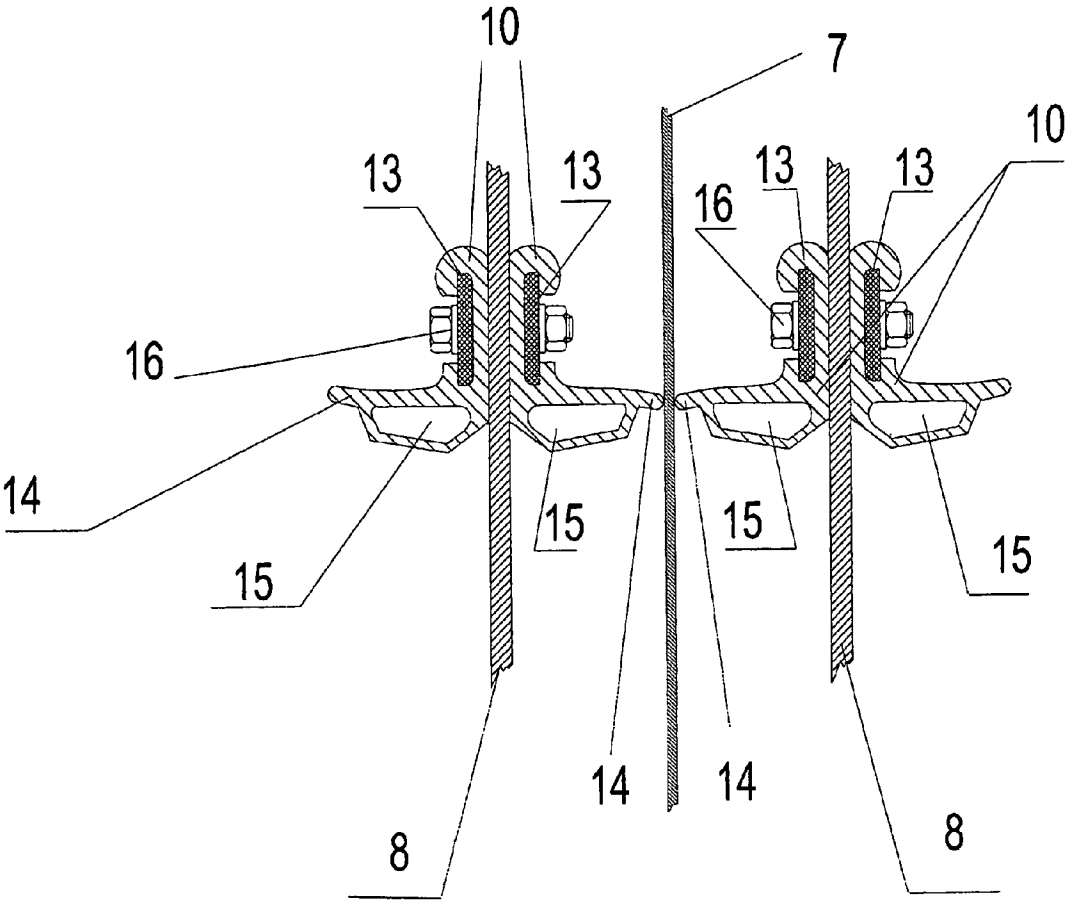
FIG. 6 represents an enlarged partial cross-sectional view of four flexible caps according to the invention, attached by bolts to the anodes and forming a seal in the intersection with a cathode that is shown between the two anodes.

In the example illustrated (see FIG. 6), flexible caps (10) are formed of a rigid part or web (13) embedded in an elastomeric material that extends toward the cathodes in the form of an eave (14), the latter having an inner hollow (15) that helps to preserve better the temperature of the electrolyte (9). The attachment means (16) of caps (10) to the anodes (8) as illustrated in the figures consist of bolts and nuts resistant to the acid in the electrolyte. Flexibility of cap (10) allows providing a continuous and airtight seal above the electrolyte, even at the time when cathodes (7) are being harvested. Protrusions or upper members (21) placed on the outer face of the top side of the lateral enclosures provide a better support of flexible caps (10) on the lateral enclosures (12) as well as a better seal in the intersections between these two elements (see FIGS. 2 to 5).

Saturation of liquid particles is to be expected as a result of mist cooling when its rate increases on passing through suction bores (20), and its pressure drops. This produces salt deposits (crystals) that tend to build up in the vicinity of suction bores (20), which may even become obstructed thus preventing suction of the mist from continuing. To avoid this, the invention provides for unobstructed entry of electrolyte (9) from the cell into lateral enclosures (12) through the lower part of the same, thereby generating a heat contribution from the electrolyte (9) to the chamber formed inside the lateral enclosures (12).

Additionally, and in the event that the heat contribution from the electrolyte (7) were not enough to prevent crystal formation, the invention provides the option of rinsing means (not shown) to wet the areas of deposition of crystal, which drag these crystals towards the electrolyte or dissolve them. Likewise, and as an option in order to reduce the amount of contaminants to be transported to the evacuation ducts (3) and the centralized suction and decontamination system (mostly acid from the electrolyte), the invention provides for arrangement of means (not shown) to incorporate contaminants back into the electrolyte (9).

The acid mist capture and removal system of the invention is easy to build, install and replace in plants that are already in operation. In addition, it does not require the use of special equipment for harvest of the cathodes, and may even be retrofitted to other acid mist capture and removal systems already installed. Some of the system's benefits to be mentioned are: a considerable improvement in the environmental conditions of the process, and consequently, in health conditions of the personnel; a longer life of the equipment and the infrastructure inside the electrowinning plant; low energy consumption requirement to capture and scrub the acid mist on account of the minimum pressure differential required in the system's operation; heat loss reduction in the process resulting in a reduction in the energy consumption required for heating of the electrolyte; improvement of cell productivity as the electrical current and correspondingly the metal electrodeposition may be increased; and scarce formation of salts due to cooling of the acid mist and controlled deposition of the same.

The invention claimed is:

1. A multi-element cover system for capture and removal of acid mist from an electrolytic cell in a metal electrowinning or electrorefining process where an electric current is passed between a plurality of electrodes, from anodes to cathodes alternately arranged and submerged in an acid solution or electrolyte, the multi-element cover system comprising an electrolyte resistant material and being applied above the electrolyte surface and below electrical connections of the electrode in order to provide a continuous and substantially airtight seal above the electrolyte, comprising:

a plurality of flexible caps arranged between anode and cathode, the caps having a longitudinally concave shape to help shift the acid mist towards the sides of the cell, using the same energy with which it disengages from the electrolyte;

lids that span the electrolyte from the electrodes placed on each end of the plurality of electrodes to the wall of the corresponding end of the cell; and lateral enclosures located on both sides of the cell, in the space between the electrodes and the lateral walls of the cell, each lateral enclosure having at least a top side, end walls at each extremity and an inner side projecting towards the electrolyte in order to form a chamber inside the lateral enclosure, either in conjunction with a bottom side arranged above the electrolyte level or with the electrolyte itself acting as the lower boundary of the chamber, wherein said chamber is connected to outer acid mist suction means and said inner side that projects towards the electrolyte has bores above the electrolyte level for, in collaboration with the flexible caps, suctioning the acid mist confined under the caps to the chamber and uniformly extract it along the entire length of the cell, with a mild suction and without the risk of crystal formation due to over saturation of the droplets contained in the mist.

2. The multi-element cover system according to claim 1, wherein the flexible caps are longitudinally U-shaped or have a similar form that slants downward from the sides to the center.

3. The multi-element cover system according to claim 1, wherein the flexible caps are fixed to every other electrode on both sides thereof, and extend towards the adjoining electrodes.

4. The multi-element cover system according to claim 3, wherein the flexible caps are built with a rigid part that confers the caps their shape and serves as a substrate for their attachment to the electrodes, and with a part made from elastomeric material that confers the caps flexibility and sealing capability.

5. The multi-element cover system according to claim 4, wherein the flexible caps comprise a web made of fiber glass or other plastic material that is embedded in the elastomeric material.

6. The multi-element cover system according to claim 4, wherein the flexible caps comprise a rigid part with a continuous groove where the piece made from elastomeric material is inserted.

7. The multi-element cover system according to claim 4, wherein the flexible caps are fastened to the electrodes by corrosion resistant bolts and nuts through one or more bores in the rigid part of the caps that match with corresponding bores of an equivalent diameter in the wall of the electrodes.

8. The multi-element cover system according to claim 4, wherein the part of the flexible caps made of elastomeric material is located substantially along the entire length of the caps and conforms an eave that spans the electrolyte up to the adjoining electrode forming a substantially adequate seal above the electrolyte.

9. The multi-element cover system according to claim 8, wherein the eave is of one piece with a shape that slants towards the electrode where it is affixed and with the border of its transverse end thinner than the rest.

10. The multi-element cover system according to claim 8, wherein the eave comprises an inner hollow to provide a thermal insulation means between the electrolyte and the environment.

11. The multi-element cover system according to claim 8, wherein the lateral ends of the caps are preferably made exclusively of an elastomeric material where these intersect the lateral enclosures, for a better seal and ease of installation.

12. The multi-element cover system according to claim 1, wherein the flexible caps include a vertical central element that descends from the cap down to the surface of the electrolyte, perpendicular to the electrodes, in order to split in two the volume of the mist evacuated from the electrolyte and thus guide the flow of mist generated in one side of the cell towards one lateral enclosure and the mist generated in the other side to the other lateral enclosure.

13. The multi-element cover system according to claim 1, wherein the lids are flat.

14. The multi-element cover system according to claim 1, wherein the lids have the same shape of the flexible caps.

15. The multi-element cover system according to claim 14, wherein the lids have the elastomeric material only at their sides and extend vertically parallel along the respective inner surfaces of the cell end walls to the cell crown where they are supported.

16. The multi-element cover system according to claim 1, wherein the lids comprise means for airtight attachment against the cell walls, such as bands or coatings of an elastomeric material.

17. The multi-element cover system according to claim 1, wherein the lateral enclosures have a shape that adapts to the space between the electrodes and the lateral inner walls of the cell.

18. The multi-element cover system according to claim 17, wherein lateral enclosures have a rectangular cross section, with a vertical side placed against the cell side.

19. The multi-element cover system according to claim 17, wherein enclosures have a polygonal cross section.

20. The multi-element cover system according to claim 17, wherein when the inner chamber is bounded by the electrolyte, the lateral enclosures have a cross section that tapers in their lower part and above the electrolyte to allow space for circulation of the impurities that float on the electrolyte.

21. The multi-element cover system according to claim 1, wherein the inner face on the top side of the lateral enclosures have a protrusion or top part attached to it, of a configuration adapted to provide a better support for the flexible caps on the lateral enclosures and to help with the seal over the electrolyte in the intersection of the flexible caps and the lateral enclosures.

22. The multi-element cover system according to claim 1, wherein the lateral enclosures are supported on the top surface of the corresponding lateral wall of the cell by means of a single or several horizontal projections that extend either over or on the same prolongation of the top side of the lateral enclosures towards the outer edges of the cell.

23. The multi-element cover system according to claim 22, wherein the horizontal projection or projections are integral and form(s) a bridge between two lateral enclosures that are installed in conjunction as a saddle on the walls of two adjacent cells that face one another.

24. The multi-element cover system according to claim 1, wherein the acid mist suction bores are disposed in the upper area of inner side of the lateral enclosure that projects to the electrolyte.

25. The multi-element cover system according to claim 1, wherein on the upper part of at least one end of each lateral enclosure a gas outlet pipe is arranged coupled to a network of gas evacuation ducts that end in a centralized suction and decontamination system.

26. The multi-element cover system according to claim 1, wherein the centralized suction and decontamination system comprises a scrubber where the acid contained in the mist is recovered, a suction pump or extractor that generates a depression that maintains the constant flow of removal of mist from the cell to the scrubber, and a chimney through which the acid-free oxygen is evacuated to the atmosphere .

27. The multi-element cover system according to claim 1, wherein the flexible caps have means to allow a controlled inflow of air from the atmosphere into the cell.

28. The multi-element cover system according to claim 27, wherein said means for allowing a controlled inflow of air from the atmosphere into each cell comprise a single central opening in the lowest part of each cap, which also acts as a drain for the water accumulated during cleaning of the cathodes .

29. The multi-element cover system according to claim 1, wherein it comprises acid mist cleaning or dissolution means in areas of potential crystal formation.

30. The multi-element cover system according to claim 1, wherein it comprises acid mist cleaning or dissolution means in the suction bores of the lateral enclosures.

31. The multi-element cover system according to claim 30, wherein the acid mist cleaning or dissolution means consist of a water chamber or duct formed in a protrusion or upper member attached to the outer face of the top side of the lateral enclosure, and hoses or sprinklers directed to the suction bores from said chamber or duct.

32. The multi-element cover system according to claim 30, wherein the acid mist cleaning or dissolution means consist of a small diameter hose that originate within the suction bores and end submerged in the electrolyte to suck the electrolyte by the effect of a pressure drop generated from the passage of mist through the bores.

33. The multi-element cover system according to claim 1, wherein the bores of the lateral enclosure have improved flow means to drag the acid mist over the edges of the bores, such as an element in the form of a nozzle that is fitted in the opening.

34. The multi-element cover system according to claim 1, wherein it comprises means for reincorporating contaminants back into the electrolyte, reducing in this way the amount of the same to be transported to the extraction ducts system connected to each lateral enclosure.

35. The multi-element cover system according to claim 34, wherein the means for reincorporating contaminants back into the electrolyte comprise one or more baffle plates inside each lateral duct, that originate on the suction bores and extend up to the electrolyte level, and that include multiple holes of a very small size or other means in order to incorporate into the electrolyte the acid particles contained in the mist.

* * * * *